US005085734A

United States Patent [19]

Griggs

[11] Patent Number: 5,085,734

[45] Date of Patent: Feb. 4, 1992

[54] METHODS OF HIGH CONSISTENCY OXYGEN DELIGNIFICATION USING A LOW CONSISTENCY ALKALI PRETREATMENT

[75] Inventor: Bruce F. Griggs, Ewing, N.J.

[73] Assignee: Union Camp Patent Holding, Inc., Princeton, N.J.

[21] Appl. No.: 489,845

[22] Filed: Mar. 2, 1990

Related U.S. Application Data

[63] Continuation of Ser. No. 311,669, Feb. 15, 1989, abandoned.

[51] Int. Cl.[5] ..... D21C 9/12; D21C 9/147

[52] U.S. Cl. ..... 162/19; 162/40; 162/56; 162/57; 162/65; 162/89

[58] Field of Search ..... 162/19, 37, 39, 40, 162/56, 18, 60, 65, 90, 88, 89

[56] References Cited

U.S. PATENT DOCUMENTS

| | | | |
|---|---|---|---|
| 1,860,432 | 5/1932 | Richter . | |
| 2,926,114 | 2/1960 | Grangaard | 162/16 |
| 3,024,158 | 3/1962 | Grangaard et al. | 162/17 |
| 3,251,730 | 5/1966 | Watanabe | 162/56 |
| 3,274,049 | 9/1966 | Gaschke et al. | 162/65 |
| 3,384,533 | 5/1968 | Meylan et al. | 162/65 |
| 3,423,282 | 1/1969 | Rerolle et al. | 162/65 |
| 3,652,388 | 3/1972 | Croon et al. | 162/65 |
| 3,660,225 | 5/1972 | Verreyne et al. | 162/17 |
| 3,661,699 | 5/1972 | Farley | 162/65 |
| 3,740,310 | 6/1973 | Smith et al. | 162/65 |
| 3,759,783 | 9/1973 | Samuelson et al. | 162/40 |
| 3,832,276 | 8/1974 | Roymoulik et al. | 162/65 |
| 3,874,992 | 4/1975 | Liebergott | 162/66 |
| 3,888,727 | 6/1975 | Kenig | 162/65 |
| 3,951,733 | 4/1976 | Phillips | 162/65 |
| 4,080,249 | 3/1978 | Kempf et al. | 162/57 |
| 4,089,737 | 5/1978 | Nagano et al. | 162/19 |
| 4,120,747 | 10/1978 | Sarge, III et al. | 162/117 |
| 4,155,806 | 5/1979 | Mannbro | 162/19 |
| 4,198,266 | 4/1980 | Kirk et al. | 162/29 |
| 4,220,498 | 9/1980 | Prough | 162/25 |
| 4,248,662 | 2/1981 | Wallick | 162/19 |
| 4,259,150 | 3/1981 | Prough | 162/40 |
| 4,274,913 | 6/1981 | Kikuiri et al. | 162/65 |
| 4,295,925 | 10/1981 | Bentvelzen et al. | 162/19 |
| 4,295,926 | 10/1981 | Bentvelzen et al. | 162/57 |
| 4,298,426 | 11/1981 | Torregrossa et al. | 162/57 |
| 4,298,427 | 11/1981 | Bentvelzen et al. | 162/57 |
| 4,363,697 | 12/1982 | Markham et al. | 162/19 |
| 4,372,812 | 2/1983 | Phillips | 162/40 |
| 4,384,920 | 5/1983 | Markham et al. | 162/19 |
| 4,431,480 | 2/1984 | Markham et al. | 162/19 |
| 4,435,249 | 2/1984 | Markham et al. | 162/24 |

(List continued on next page.)

FOREIGN PATENT DOCUMENTS

| | | |
|---|---|---|
| 1119360 | 3/1982 | Canada . |
| 1132760 | 10/1982 | Canada . |
| 1154205 | 9/1983 | Canada . |
| 062539 | 10/1982 | European Pat. Off. . |
| 106460 | 4/1984 | European Pat. Off. . |
| 106609 | 4/1984 | European Pat. Off. . |

OTHER PUBLICATIONS

Fossum et al., "Final Bleaching of Kraft Pulps Delignified To Low Kappa No. By Oxygen Bleaching", *Tappi Journal*, vol. 66, No. 12, Dec. 1983.

(List continued on next page.)

*Primary Examiner*—Steve Alvo
*Attorney, Agent, or Firm*—Pennie & Edmonds

[57] ABSTRACT

A method for the production of delignified wood pulp is provided which result in said pulp's having improved delignification ratios. In accordance with preferred embodiments, brownstocks are substantially uniformly treated with aqueous alkaline solution while in a state of low consistency. The consistency is then increased to values preferably in excess of about 20% and the brownstock treated with oxygen to effect delignification. The processes of the invention provide surprising improvements over prior methods in the high strength, low lignin containing pulps may be formed thereby. These pulps can be further bleached to high brightness with less subsequent bleach chemical.

14 Claims, 1 Drawing Sheet

U.S. PATENT DOCUMENTS

| | | | |
|---|---|---|---|
| 4,439,271 | 3/1984 | Samuelson | 162/19 |
| 4,450,044 | 5/1984 | Fritzvold et al. | 162/65 |
| 4,451,332 | 5/1984 | Annergren et al. | 162/89 |
| 4,459,174 | 7/1984 | Papageorges et al. | 162/40 |
| 4,568,420 | 2/1986 | Nonni | 162/65 |
| 4,595,455 | 6/1986 | Mannbro | 162/38 |
| 4,619,733 | 10/1986 | Kooi | 162/30.1 |
| 4,806,203 | 2/1989 | Elton | 162/19 |
| 4,834,837 | 5/1989 | Loquenz et al. | 162/19 |
| 4,840,703 | 6/1989 | Malmsten | 162/49 |

OTHER PUBLICATIONS

Kirk et al., "Low Consistency Oxygen Delignification In A Pipeline Reactor," Tappi, vol. 61, No. 5, pp.

Singh et al., "The Bleaching of Pulp", Tappi, 3rd ed., Chapter 7 (1979).

Smook, "Handbook For Pulp and Paper Technologists," Chapter 11 (1982).

Abrahamsson et al., "Oxygen/Sodium Carbonate Bleaching of Kraft Pulp Pretreated with Nitrogen Dioxide and Oxygen", Svensk Papperstidning (1983).

Allison, "Production of Bleached Softwood Pulp by Low Pollution Processes", Wood Sci. Technol. 17, pp. 129-137 (1983).

Andtbaka, "Low Kappa Pulping Followed by Oxygen Delignification", Appita, vol. 39, No. 2 (1986).

Brannland et al., "How to Cope With TOCL", International Oxygen Delignification Conference (1987).

Carlberg et al., "Bleaching of Sulphite and Sulphate Pulps Using Conventional and Unconventnional Sequences", TAPPI Proceedings 1982 Annual Meeting, p. 381.

Casey, J. P., "Bleaching: A Perspective", *TAPPI Journal,* vol. 66, No. 7 (Jul. 1983), p. 95.

Christensen, P. K., "Bleaching of Sulphate Pulps With Hydrogen Peroxide".

DeSousa et al., "The Influence of Chlorine Ratio and Oxygen Bleaching on the Formation of PCDF's and PCCD's in Pulp Bleaching", TAPPI Journal (Apr. 1989).

Elton et al., "New Technology for Medium-Consistency Oxygen Bleaching".

Fujii et al., "Oxygen Pulping of Hardwoods," TAPPI, Alkaline Pulping/Secondary Fibers Conference (Washington, D.C., Nov. 7-10, 1977).

Gellerstedt et al., "Singlet Oxygen Oxidation of Lignin Structures," *Singlet Oxygen,* Chapter 31, pp. 302-310 (Sep. 1976).

Germgard et al., "Mathematical Models for Simulation and Control of Bleaching Stages", Nordic Pulp and Paper Research Journal, No. 1 (1987).

Gierer, "Chemistry of Delignification, Part 2: Reactions of Lignins During Bleaching", Word Science and Technology (1986).

Gierer, "Mechanisms of Bleach with Oxygen-Containing Species", ISWPC (1987).

Gupta et al., "OZ Prebleaching, Influence on Viscosity and Sheet Strength", TAPPI Symposium-Oxygen Delignification, p. 1 (1984).

Heimburger et al., "Kraft Mill Bleach Plant Effluents: Recent Developments Aimed at Decreasing Their Environmental Impact".

Heimburger et al., "Kraft Mill Bleach Plant Effluents: Recent Developments Aimed at Decreasing Their Environmental Impact Part II", TAPPI Journal, p. 69 (Nov. 1988).

Jamieson et al., "Integration of Oxygen Bleaching in the Brown Stock Washing System", Svensk Papperstidning (1973).

Leopold, B., "The Pulp Mill of the Future", *Textile and Paper Chemistry and Technology,* p. 239.

Leopold, B., "The Pulping Process—Opportunity or Headache?", Proceedings of IPC Conference, Paper Science and Technology, May 8-10, 1979.

Liebergott et al., "The Use of Ozone in Bleaching and Brightening Wood Pulps: Part I—Chemical Pulps" (TAPPI 1978).

Liebergott et al., "The Use of Ozone or Oxygen in the First Bleaching State", *Ozone: Science and Engineering,* vol. 4, p. 109 (1982).

Liebergott et al., "Bleaching a Softwood Kraft Pulp Without Chlorine Compounds", TAPPI Journal, p. 76 (Aug. 1984).

Liebergott et al., "Bleaching a Softwood Kraft Pulp Without Chlorine Compounds", pp. 1-10.

Liebergott et al., "Comparison Between Oxygen and Ozone Delignification in the Bleachig of Kraft Pulps", TAPPI Proceedings—1981 Pulping Conference, p. 157.

McDonough, "Oxygen Bleaching's Pace Quickens", IPC Technical Paper Series, No. 246 (Jul. 1987).

Ohnishi, K., "Japan: Pulping, Bleaching", *Pulp and Paper* (Aug. 1978), p. 88.

Ow et al., "Advances In Ozone Bleaching: Part II—Bleaching of Softwood Kraft Pulps With Oxygen and Ozone Combination", TAPPI Symposium—Oxygen Delignification (1984).

(List continued on next page.)

OTHER PUBLICATIONS

Partridge, H., "New Pulp Bleaching Developments", *CEP* (Jun. 1976).

Partridge, H., "An Overview of New Pulp Bleaching Developments", AIChE National Meeting, Paper No. 24a (Sep. 7–10, 1975).

Perkins et al., "Advances in Ozone Bleaching—Part III—Pilot Plant Installations and Proposed Commercial Implementation".

Seifert et al., "Engineering Considerations in the Design of Oxygen Reactors", p. 309.

Soteland, N., "Bleaching of Chemical Pulps With Oxygen and Ozone", Pulp and Paper Magazine of Canada, vol. 75, No. 4 (Apr. 1974), p. 91.

Soteland, N., "Bleaching of Chemical Pulps with Oxygen and Ozone", *Norsk Skogindustri* (Sep. 1978), p. 199.

Soteland, "Comparison Between Oxygen and Ozone Delignificaiton of Sulphite Pulps", TAPPI Symposium—Oxygen Delignification, p. 71 (1984).

Wong et al., "Toxicity, BOD and Color of Effluents From Novel Bleaching Processes", *Pulp and Paper Magazine of Canada,* vol. 79, No. 7 (Jul. 1978), p. 41.

METHODS OF HIGH CONSISTENCY OXYGEN DELIGNIFICATION USING A LOW CONSISTENCY ALKALI PRETREATMENT

This is a continuation of application Ser. No. 07/311,669, filed Feb. 15, 1989, now abandoned.

BACKGROUND OF THE INVENTION

The present invention relates to methods for the treatment of wood pulp, and more particularly to methods for oxygen delignification of the brownstock produced during standard pulping operations. In particular, the present invention is directed to the production of wood pulp having greatly improved strength concomitant with high degrees of delignification.

Wood is comprised in major proportion of cellulose and hemicellulose fiber and amorphous, non-fibrous lignin which serves to hold the fibrous portions together. The hemicellulose and the cellulose fibers are sometimes referred to collectively as holocellulose. During the treatment of wood to produce pulp, the wood is transformed into a fibrous mass by removing a substantial portion of the lignin from the wood. Thus, processes for the production of paper and paper products generally include a pulping stage in which wood, usually in the form of wood chips, is reduced to a fibrous mass. Several different pulping methods are known in the art; they are generally classified as mechanical, chemical or semi-chemical pulping.

Although mechanical pulping is still used in the paper making industry, chemical and semichemical pulping currently account for about 70% of North American production. Chemical pulping methods include a wide variety of processes, such as the sulphite process, the bisulfite process, the soda process and the Kraft process. The Kraft process is the predominant form of chemical pulping.

Chemical pulping operations generally comprise introducing wood chips into a digesting vessel where they are cooked in a chemical liquor. In the Kraft process, the cooking liquor comprises a mixture of sodium hydroxide and sodium sulphide. After the required cooking period, softened and delignified wood chips are separated from the cooking liquor to produce a fibrous mass of pulp. The pulp produced by chemical pulping is sometimes called "brownstock" because it is typically too dark in color for the production of many paper products. The brownstock is typically washed to remove cooking liquor and then processed for the production of unbleached grades of paper products or, alternatively, bleached for the production of high grade, high brightness paper products.

Since chromophoric groups on the lignin are principally responsible for color in the pulp, most methods for the bleaching of brownstock require further delignification of the brownstock. For example, the brownstock may be reacted with elemental chlorine in an acidic medium or with hypochlorite in an alkaline solution to effect this further delignification. These steps are typically followed by reactions with chlorine dioxide to produce a fully bleached product. Oxygen delignification, because it uses inexpensive bleach chemicals and produces by-products which can be burned in a recovery boiler reducing environmental pollutants, is a method that has been used at an increasing rate in recent years for the bleaching of wood pulp in general and brownstock in particular. Oxygen bleaching is frequently followed by subsequent bleach stages of the chlorine or chlorine dioxide type which then require less bleach chemical and produce less environmental pollutants because of the bleaching achieved in the oxygen stage. Unfortunately, most bleaching processes based upon lignin removal have a tendency to degrade a proportion of the holocellulose in the pulp. This degradation is highly undesirable since it adversely affects pulp strength.

In some bleaching processes, the pulp is bleached while being maintained at low to medium levels of pulp consistency. Pulp consistency is a measure of the percentage of solid fibrous material in pulp. Pulps having a consistency of less than about 10% by weight are said to be in the low to medium range of pulp consistency. Processes which require bleaching at low to medium consistency pulp are described in the following patents and publications: U.S. Pat. No. 4,198,266, issued to Kirk et al; U.S. Pat. No. 4,431,480, issued to Markham et al; U.S. Pat. No. 4,220,498, issued to Prough; and an article by Kirk et al. entitled "Low-consistency oxygen delignification in a pipeline reactor—A pilot study", TAPPI, May 1978. Each of the foregoing describe an oxygen delignification step that operates upon pulps in the low to medium consistency range.

Oxygen bleaching of wood pulp is typically carried out on fluffed, high consistency pulp in a pressurized reactor. The consistency of the pulp is typically maintained between about 20% and 30% by weight during the oxygen delignification step. Gaseous oxygen at pressures of from about 80 to about 100 psig is introduced into and reacted with the high consistency pulp. See, G. A. Smook, *Handbook for Pulp and Paper Technologists,* Chapter 11.4 (1982). In previous oxygen bleaching operations, the pulp from the cooking vessel is dewatered to produce a high consistency mat. The pulp mat is then covered with a thin film or layer of an alkaline solution, generally by spraying the solution onto the surface of the mat. The alkaline solution is typically applied at a rate of about 1.9 to about 7% by weight of dry pulp.

Previously used high consistency oxygen bleaching processes have several disadvantages. In particular, it has now been found that spraying an alkaline solution onto a mat of high consistency pulp does not provide an even distribution of solution throughout the fibrous mass, notwithstanding the generally porous nature of such mats. As a result of this uneven distribution, certain areas of the high consistency mat, usually the outer portions, are exposed to excessive amounts of the alkaline solution. This excessive exposure is believed to cause nonselective degradation of the holocellulosic materials resulting in a relatively weak pulp at least locally. On the other hand, other portions of the high consistency mat, typically the inner portions, may not be sufficiently exposed to the alkaline solution to achieve the desired degree of delignification. Thus, overall quality declines. Applicants have now discovered methods for the production of bleached pulp through high consistency oxygen delignification processes having greater strength and lower lignin content than has been attainable in accordance with prior methods.

SUMMARY OF THE INVENTION

It is highly desirable and an object of the present invention to provide improved methods for oxygen delignification of high consistency wood pulp in general and brownstock in particular.

It is also an object of the present invention to provide methods for enhancing the selectivity of high consistency oxygen delignification reactions.

It is a further object of the present invention to provide methods for producing bleached pulp of high strength and low lignin content in high consistency oxygen delignification processes.

In order to achieve these and other objects of the present invention, and to avoid the disadvantages of the prior art, the present invention provides improved processes for production of bleached pulp comprising pretreating the pulp at low consistency with an aqueous alkaline solution, increasing the consistency of the pretreated pulp and then subjecting the pretreated pulp to high consistency oxygen delignification. According to a preferred practice of the present invention, the pretreatment step comprises substantially uniformly distributing an aqueous alkaline solution throughout the pulp while maintaining said pulp at a consistency of less than about 10% and preferably less than about 5% by weight. The alkalinity is selected to achieve the desired extent of delignification in the subsequent oxygen delignification step carried out at high pulp consistency.

A further aspect of the present invention is the provision of processes that provide uniform distributions of an aqueous alkaline solution throughout low to medium consistency brownstocks followed by high consistency oxygen delignification of the pretreated pulp. The provision and sequencing of such a distribution step provides processes that produce bleached paper products having superior strength and color when compared to paper products made according to typical, prior, high consistency oxygen delignification processes.

DESCRIPTION OF PREFERRED EMBODIMENTS

Figure 1:
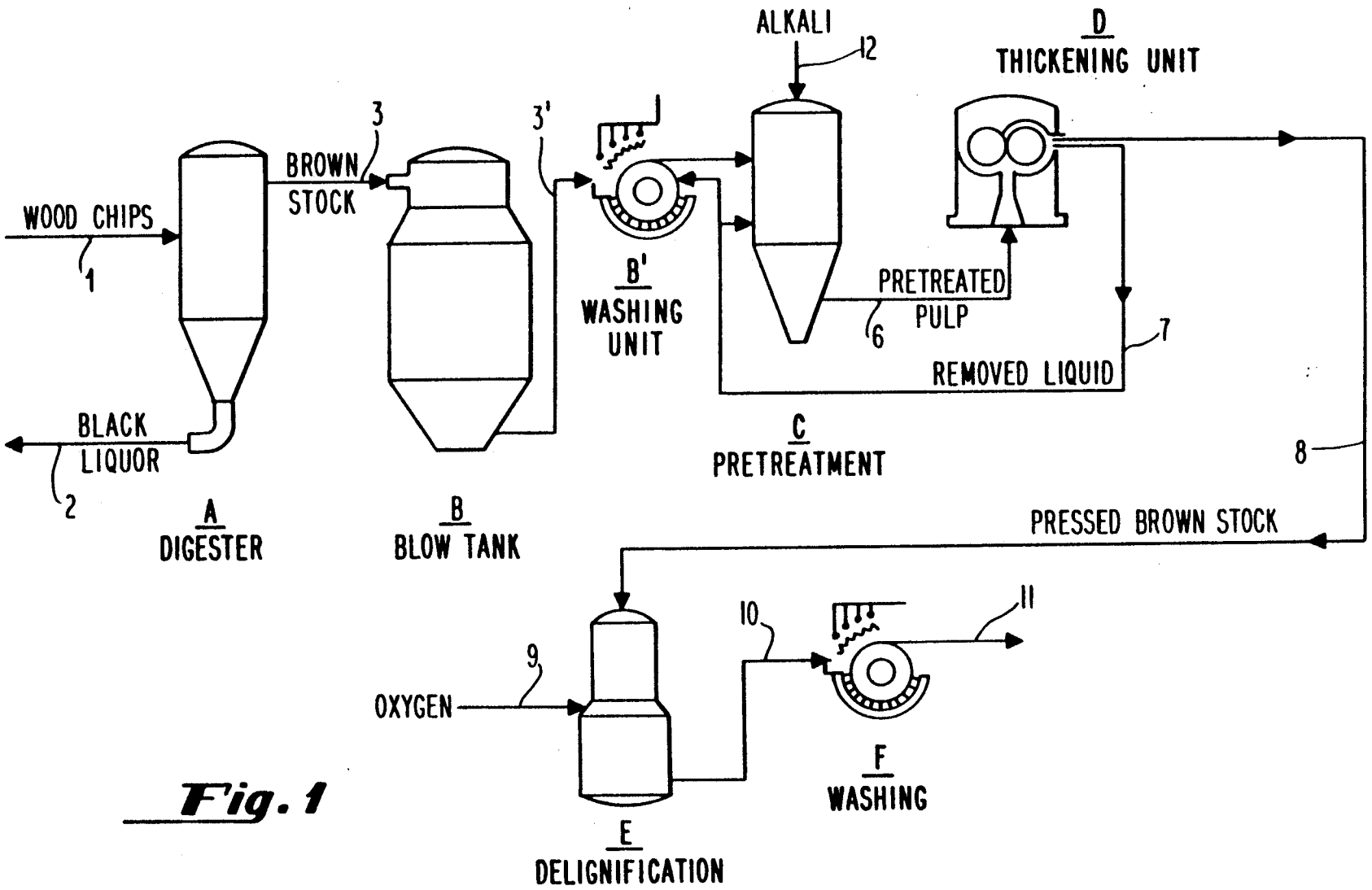
FIG. 1 is a schematic representation of one embodiment of the present invention.

The present invention relates to improved processes for the high consistency oxygen delignification of wood pulp. The methods generally comprise treating wood pulp with an aqueous, alkaline solution while maintaining the consistency of the pulp at less than about 10% by weight. The methods further comprise increasing the consistency of the pretreated pulp to at least about 20% by weight to produce a high consistency brownstock. The pretreated, high consistency brownstock is then subjected to oxygen delignification to produce bleached wood pulp having high strength and low lignin content. These pulps can be further bleached to high brightness with less subsequent bleach chemical.

According to certain embodiments, the methods of the present invention provide high quality, high strength, bleached wood pulp from the Kraft or other alkaline pulping processes. These embodiments include the step of cooking wood chips or other fibrous materials in a cooking liquor comprising, for example, sodium hydroxide and sodium sulfide. This cooking step is traditionally called Kraft cooking or the Kraft process and is well known in the art. The pulp produced by this process is known as Kraft pulp or Kraft brownstock. The cooking step is typically carried out in a batch operation, although continuous Kraft cooking operations are also used.

According to a preferred embodiment of the present invention, wood chips and a white liquor comprising sodium hydroxide and sodium sulfide are introduced into a digester vessel. It is preferred that sufficient white liquor be introduced into the digester to substantially cover the wood chips. The contents of the digester are then heated at a temperature and for a time sufficient to allow the white liquor to substantially impregnate the wood chips and substantially complete the cooking reactions, as is well understood by those skilled in the art. A large number of process parameters, such as chip size, chip quality, liquor sulfidity, cooking temperature, and cooking time are known to have an impact on the operation of the cooking process. Accordingly, these and other parameters that affect the cooking process can be varied over a wide range according to techniques well known in the art to obtain a pulp with a wide variety of properties.

The present invention relates to improved processes for oxygen delignification of high consistency wood pulp. An important feature of the present invention resides in the provision of a low to medium consistency pulp pretreating step followed by a high consistency pulp oxygen delignification step. The pretreatment step of the present invention comprises substantially uniformly treating wood pulp, preferably Kraft brownstock, with aqueous alkaline solution while maintaining the consistency of the pulp at less than about 10% and preferably less than about 5% by weight. As a matter of convenience, the consistency of the pulp is generally greater than about 0.5% since lesser consistencies are not economical. According to a preferred embodiment of the present invention, the pretreatment step comprises uniformly distributing an aqueous alkaline solution throughout a low consistency brownstock to ensure that substantially all the brownstock fibers are exposed to a uniform application of alkaline solution. Applicants have found that surprisingly, brownstocks treated in this manner are more effectively delignified in subsequent high consistency oxygen delignification reactions than brownstocks that are treated with alkaline solutions at high consistency according to the methods disclosed in the prior art. At the same time, localized inhomogeneities in distribution of alkali into high consistency pulp are avoided, thus avoiding the attendant weakness and high color resulting from such inhomogeneities.

The step of substantially uniformly distributing an aqueous alkaline solution throughout a low consistency brownstock comprises uniformly mixing low consistency brownstock with an aqueous alkaline solution to produce a homogeneous pulp having a consistency of less than about 10% and preferably less than about 5% by weight. It is preferred that the consistency of the brownstock be maintained between about 0.5% and about 4.5% by weight during the mixing step. The homogeneous distribution step preferably comprises uniformly mixing the pulp with an aqueous alkaline solution for at least about 1 minute and preferably no more than about 15 minutes. It is believed that treatment times less than about 1 minute will not generally provide sufficient time to attain substantially uniform distribution whereas treatment times in excess of 15 minutes are not expected to produce substantial further benefit.

It is believed that the pretreatment step of the present invention can be carried out over a wide range of temperature conditions. According to a preferred practice of the present invention, however, the treatment step is carried out at a temperature of from about room temperature to about 140° F., with temperatures ranging from about 90° F. to about 120° F. being even more preferred. Standard pressure or elevated pressure may be employed.

The amount of aqueous alkaline solution present in the pretreatment step of the present invention can vary greatly according to the particular process parameters of the delignification reaction; such variation in the amount of aqueous alkali is within the scope of the present invention. As will be appreciated by those skilled in the art, the amount of alkaline solution effective for the purpose of the present invention will depend primarily upon the extent of delignification desired in the oxygen bleaching step and the strength of the particular solution being used. The aqueous alkaline solutions of the present invention preferably comprise a sodium hydroxide solution having a concentration of from about 20 to about 120 g/l. According to preferred embodiments of the present invention, an aqueous sodium hydroxide solution is added to the low consistency pulp in an amount sufficient to provide from about 15 to about 30% by weight of sodium hydroxide based on dry pulp weight. Other alkali sources having equivalent sodium hydroxide content can be employed.

It is believed that uniform distribution of the caustic solution according to the methods of the present invention ensures that the pulp fibers are more optimally treated than is otherwise possible according to prior techniques. As a result, the bleached brownstocks produced according to the present invention have strength and degrees of delignification that are generally superior to bleached brownstocks of the prior art. Although applicants do not intend to be bound by or to any particular theory, it is believed that this more optimal application of the caustic solution accounts for an unexpected improvement in the properties of the bleached pulp. The capacity to obtain such uniform distribution is provided, in part, by the provision of a treatment step in which the brownstock is maintained at low pulp consistencies. More particularly, it has been discovered that when wood pulp is maintained at a consistency of less than about 10% by weight, and preferably less than about 5%, the fibrous portion of the pulp is readily mixed with the caustic solution to produce a homogenous distribution of caustic in the pulp and that such a homogeneous distribution produces improvements in the subsequent high consistency oxygen delignification process.

It has been found that the treatment of low consistency brownstock with an aqueous alkaline solution according to the present invention produces unexpected and beneficial results. For example, applicants have discovered that the delignification selectivity of the oxygen delignification reaction is unexpectedly improved by the pretreatments of the present invention. As the term is used herein, delignification selectivity is a measure of cellulosic degradation relative to the extent of lignin remaining. Thus selectivity is the measure of a reaction's tendency to produce a strong pulp with low lignin content. The selectivity of an oxygen delignification reaction can be measured, for example, by the ratio of pulp viscosity to Kappa number. As is well understood by those skilled in the art, the viscosity of a bleached pulp is a measure of the degree of polymerization of the cellulose in the bleached pulp and as such is a measure of the strength of the pulp. On the other hand, Kappa number represents the amount of lignin remaining in the pulp. Accordingly, an oxygen delignification reaction that has a high selectivity produces a bleached pulp of high strength and low lignin content.

Following the low consistency, caustic pretreatment step described above, methods of the present invention require increasing the consistency of the pretreated pulp to greater than about 20%, preferably from about 25% to about 35%. Several methods are available and well known in the art for increasing the consistency of the pulp, such as pressing the wood pulp to remove liquid therefrom.

The methods of the present invention further require oxygen delignification of the high consistency pulp. Methods are available and well known in the art for dissolving gaseous oxygen into the liquid phase of high consistency pulp to affect delignification thereof. It is contemplated that any of these well known methods are adaptable for use according to the present invention. It is preferred, however, that oxygen delignification according the present invention comprise introducing gaseous oxygen at about 80 to about 100 psig into the liquid phase of the high consistency pulp while maintaining the temperature of the pulp between about 90° C. and 130° C. The average contact time between the high consistency pulp and the gaseous oxygen is preferably from about 20 minutes to about 60 minutes.

Although it is contemplated that all Kraft brownstocks are suitable for use according to the present invention, it has been found that the present methods produce surprising and unexpected results when the kraft cooking step is operated to produce brownstocks having relatively low Kappa numbers. As is well understood by those skilled in the art, low Kappa number brownstocks are relatively difficult to process in previous oxygen bleaching operations because of the negative impact such operations tend to have on the strength of the pulp. Accordingly, it has been heretofore relatively difficult to obtain products of acceptable strength and color from low Kappa number Kraft brownstocks. Applicants have found, however, that the processes of the present invention are particularly well adapted for use with the Kraft brownstock having a Kappa number of about 20 to about 22.

One specific processing scheme for carrying out the methods steps of the present invention is depicted in schematic form in FIG. 1. The steps depicted by FIG. 1 represent a preferred operating system that tends to maximize certain benefits of the present invention. Wood chips 1 are introduced into a digester "A" were they are cooked in a liquor such as a liquor of sodium hydroxide and sodium sulfide. The cooking unit "A" produces a black liquor 2 containing the reaction products of lignin solubilization together with Kraft brownstock 3. The brownstock is treated in washing units comprising, preferably, blow tank "B" and washing stage "B" where residual liquor contained in the pulp is removed. Many methods are available and well known in the art for washing brownstock, such as diffusion washing, rotary pressure washing, horizontal belt filtering, and dilution/extraction. These methods are all within the scope of the present invention.

The washed brownstock is introduced into a pretreatment unit "C" where it is treated with an alkaline solution and maintained at a consistency of less than about 10% and preferably less than about 5%. The process of the present invention preferably includes means for introducing make-up caustic 12 into the pretreatment stage to maintain the desired caustic application level. The pretreated pulp 6 is forwarded to a thickening unit "D" where the consistency of the pulp is increased, by pressing for example, to at least about 20% by weight and preferably to about 25% to about 35%. The liquid 7 removed during the thickening step "D" is preferably returned to the pretreatment stage "C" and the washing unit "B" for further use. The high consistency brownstock 8 produced in the thickening stage "D" is forwarded to an oxygen delignification stage "E" where it is contacted with gaseous oxygen 9. The delignified brownstock 10 is preferably forwarded to a second washing stage "F" wherein the pulp is washed with water to remove any dissolved organics and to produce high quality, low color pulp 11. From here pulp 11 could be sent to subsequent known bleaching stages to produce a fully bleached product.

In order to illustrate the benefits and superior performance of the present invention, several tests were conducted utilizing several processing schemes, including processing schemes similar to the scheme depicted in FIG. 1.

EXAMPLE 1 Comparative Example

A pine Kraft brownstock having a Kappa number of about 30.9 was pressed without pretreatment to a consistency of about 30-36% by weight to produce a high consistency mat of brownstock. The mat of brownstock was sprayed with a 10% sodium hydroxide solution in an amount sufficient to produce approximately 2.5 weight percent sodium hydroxide based on pulp dry weight. Dilution water is added in an amount sufficient to adjust the brownstock mat to about 27% consistency. The high consistency brownstock mat was then subjected to oxygen delignification using the following conditions: 110° C., 30 minutes, 80 psig $O_2$. The oxygen delignified pulp produced according to this procedure was tested and found to have a Kappa number of 15.2 and a CED viscosity of about 14.8 cps. This oxygen bleached pulp was further bleached by known technology in the stages: chlorine, caustic extraction and chlorine dioxide to 83 G.E. brightness using the conditions in Table 2 and the chemical charges on an oven dried fiber basis listed in Table 3. Pulps were well washed between bleaching stages. The strength properties of the fully bleached pulp are shown in Table 4.

EXAMPLE 2 This Invention

Pine Kraft brownstock of Example 1 was introduced into a pretreatment vessel along with a sufficient volume of 10% NaOH solution to effect a 30% NaOH addition based on oven-dried pulp. Sufficient dilution water was added to obtain a brownstock consistency of about 3% by weight in the pretreatment vessel. The brownstock and the aqueous sodium hydroxide solution were uniformly mixed at room temperature by a ribbon mixer for about 15 minutes to produce a pretreated brownstock. The pretreated brownstock was then pressed to a consistency of about 27% by weight. After pressing, the sodium hydroxide on the fiber equaled about 2.5% as in Exhibit 1. The pretreated brownstock was then bleached according to the oxygen delignification procedure described in Example 1. The oxygen delignified pulp was then washed to remove organics. The resulting oxygen stage pulp had a Kappa number of 10.8 and a CED viscosity of 14.0. The oxygen bleached pulp made by this invention was further bleached by known technology in the stages: chlorine, caustic extraction and chlorine dioxide to 83 G.E. brightness using the conditions in Table 2 and the chemical charges on an oven dried fiber basis listed in Table 3. The pulps were well washed between bleaching stages. The properties of the fully bleached pulp by this invention are shown in Table 4.

TABLE 1

Comparison of Oxygen Stage Bleaching Results on pulps produced by Example 1 and Example 2

| | EXAMPLE 1 | EXAMPLE 2 |
|---|---|---|
| Kappa no. | 15.2 | 10.8 |
| Viscosity (cps) | 14.8 | 14.0 |

TABLE 2

Bleaching Conditions in the Chlorine, Extraction and Chlorine Dioxide Stages for Example 1 and Example 2

| | |
|---|---|
| Chlorine Stage | |
| Time, min. | 15 |
| Temperature, °C. | 50 |
| Consistency, % | 3.15 |
| Extraction Stage | |
| Time, min. | 60 |
| Temperature, °C. | 70 |
| Consistency, % | 12 |
| Chlorine Dioxide Stage | |
| Time, min. | 120 |
| Temperature, °C. | 60 |
| Consistency, % | 12 |

TABLE 3

Bleach Chemical Usage in Chlorine, Extraction and Chlorine Dioxide Stages

| | Example 1 | Example 2 |
|---|---|---|
| Chlorine Stage | | |
| Chlorine, % on fiber | 3.6 | 2.4 |
| Chlorine Dioxide, % on fiber | 0.6 | 0.4 |
| Extraction Stage | | |
| Sodium Hydroxide, % on fiber | 1.5 | 1.5 |
| Chlorine Dioxide Stage | | |
| Chlorine Dioxide, % on fiber | 0.28 | 0.23 |

TABLE 4

Comparison of Fully Bleached Strength Properties of pulps produced by Example 1 and Example 2

| | EXAMPLE 1 | | EXAMPLE 2 | |
|---|---|---|---|---|
| Final G.E. brightness, % | 83 | | 83 | |
| C.S. Freeness, ml. | Breaking Length-km | Tear Factor, $Dm^2$ | Breaking Length-km | Tear Factor, $Dm^2$ |
| 658 | 6.42 | 55.7 | 7.00 | 55.5 |
| 516 | 8.25 | 73.6 | 8.35 | 67.4 |
| 337 | 8.80 | 74.1 | 9.07 | 71.8 |

As can be seen from a comparison of Examples 1 and 2, the methods of the present invention produce a bleached brownstock having greater delignification (lower Kappa number) than the prior art methods, without any substantial change in strength properties.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims.

What is claimed is:

1. A process for producing bleached wood pulp, said process including a high consistency oxygen delignification step and comprising:

cooking wood to provide unbleached brownstock;

pretreating said unbleached brownstock prior to the oxygen delignification step by uniformly mixing the unbleached brownstock with an aqueous alkaline solution at a pulp consistency of about 0.5 to 4.5% by weight, said aqueous alkaline solution being present in an amount effective to promote delignification in a subsequent high consistency oxygen delignification step;

mixing the unbleached brownstock at a consistency of about 0.5 to 4.5% by weight, and continuing the alkali pretreatment without removing the alkaline solution for at least a predetermined time at a predetermined temperature and pressure, said predetermined time, temperature and pressure being selected to effect an uninterrupted completion of the pretreatment of the unbleached brownstock and thereby provide substantially uniform pretreatment to ensure that all brownstock fibers are exposed to a uniform application of the aqueous alkaline solution with an amount of alkaline material which, after increasing the consistency of the pulp for subsequent high consistency oxygen delignification, is sufficient to cause an increase in the delignification of the unbleached brownstock pulp without a corresponding decrease in pulp viscosity during the subsequent high consistency oxygen delignification step as compared to unbleached brownstock which is treated at high consistencies with an alkaline solution;

at the completion of the pretreating step, removing liquid from the pretreated brownstock to increase its consistency to at least about 20% to form pretreated, high consistency brownstock while retaining at least about 1.9 percent by weight based on the dry weight of the pulp of alkaline material on the increased consistency pulp for subsequent high consistency oxygen delignification, wherein the brownstock fibers containing the aqueous alkaline solution are directly passed from the pretreatment step to the liquid removal step;

recycling substantially all of the liquid removed from the pretreated brownstock during the liquid removal step directly to the unbleached brownstock pretreating step; and substantially delignifying said pretreated high consistency brownstock during oxygen delignifiation.

2. The process of claim 1 wherein said aqueous alkaline solution is present in an amount of from about 15% to about 30% by dry weight of the brownstock after pretreating.

3. The process of claim 1 wherein said pretreating step is conducted from about 1 to about 15 minutes.

4. The process of claim 1 wherein said step of increasing the consistency of the brownstock comprises increasing the consistency of the brownstock to a consistency of from about 25% to about 35%.

5. The process of claim 1 wherein the pulp is delignified without substantially changing the viscosity of the pulp.

6. The process of claim 1 which further comprises decreasing the Kappa number of the increased consistency pulp by about 65% during the delignification step without significantly damaging the cellulose components of the pulp.

7. The process of claim 1 wherein the Kappa number is decreased from about 30.9 before delignification to about 10.8 after delignification.

8. The process of claim 1 wherein the aqueous alkaline solution has a concentration of alkaline materials of between about 20 and 120 g/l.

9. The process of claim 1 wherein the mixing step is conducted for a time of between about 1 and 15 minutes at a temperature of between 90° and 140° F.

10. The process of claim 1 which further comprises subjecting the oxygen delignified pulp to a chlorine/-chlorine dioxide bleaching process utilizing substantially reduced amounts of total chlorine compared to pulp which is not uniformly combined with alkaline material prior to delignification while obtaining substantially the same degree of brightness.

11. The process of claim 10 wherein the amount of chlorine-containing chemicals utilized is reduced by about 32 percent by weight compared to the amount needed for pulp which is not uniformly combined with alkaline material prior to delignification.

12. The process of claim 10 wherein the amount of chlorine dioxide utilized is reduced by about 28.4 percent by weight compared to the amount needed for pulp which is not uniformly combined with alkaline material prior to delignification.

13. The process of claim 1 wherein the amount of alkaline material which remains on the pretreated, high consistency brownstock is between about 1.9 and 7 percent by weight of dry pulp.

14. The process of claim 1 wherein the amount of alkaline material which remains on the pretreated, high consistency brownstock is at least about 2.5 percent by weight of dry pulp.

* * * * *